US008230824B2

(12) United States Patent
Yao

(10) Patent No.: US 8,230,824 B2
(45) Date of Patent: Jul. 31, 2012

(54) STEAM JETTING DEVICE

(75) Inventor: Isoji Yao, Higashiosaka (JP)

(73) Assignee: Naomoto Corporation, Osaka (JP)

( * ) Notice: Subject to any disclaimer, the term of this patent is extended or adjusted under 35 U.S.C. 154(b) by 820 days.

(21) Appl. No.: 12/225,926

(22) PCT Filed: Feb. 19, 2007

(86) PCT No.: PCT/JP2007/052975

§ 371 (c)(1),
(2), (4) Date: Oct. 2, 2008

(87) PCT Pub. No.: WO2007/113944

PCT Pub. Date: Oct. 11, 2007

(65) Prior Publication Data

US 2009/0133645 A1 May 28, 2009

(30) Foreign Application Priority Data

Apr. 5, 2006 (JP) ..... 2006-104445

(51) Int. Cl.
*F22B 37/18* (2006.01)

(52) U.S. Cl. ..... 122/379; 122/404; 122/DIG. 10; 392/399

(58) Field of Classification Search ..... 122/379, 122/400, 404, 397, DIG. 10; 392/394, 396, 392/398, 399, 403–406; 110/150, 161
See application file for complete search history.

(56) References Cited

U.S. PATENT DOCUMENTS

| | | | | |
|---|---|---|---|---|
| 4,300,556 | A * | 11/1981 | Ochi et al. | 604/291 |
| 4,399,349 | A * | 8/1983 | Deming et al. | 392/403 |
| 5,553,187 | A | 9/1996 | Lippo | |
| 5,984,952 | A | 11/1999 | Chang | |
| 6,236,808 | B1 | 5/2001 | Jordan et al. | |

FOREIGN PATENT DOCUMENTS

| | | |
|---|---|---|
| EP | 1 386 598 A1 | 2/2004 |
| GB | 409 145 A | 4/1934 |
| JP | U-3-14501 | 2/1991 |
| JP | A-6-134017 | 5/1994 |
| JP | A-6-254133 | 9/1994 |
| JP | U-3054750 | 9/1998 |
| JP | A-2002-209971 | 5/2001 |
| JP | A-2002-209971 | 7/2002 |
| JP | A-2003-93471 | 4/2003 |

OTHER PUBLICATIONS

PCT International Search Report mailed on Apr. 10, 2007 for the corresponding international patent application No. PCT/JP2007/052975.
Office Action mailed Jul. 19, 2011 in corresponding JP application No. 2006-104445.
Supplementary European Search report dated Feb. 21, 2012 for the corresponding EP patent application No. EP 07 71 4501.

* cited by examiner

*Primary Examiner* — Gregory A Wilson
(74) *Attorney, Agent, or Firm* — Posz Law Group, PLC

(57) ABSTRACT

A steam ejection device including a steam generator for generating steam by heating water; a steam eject port for discharging the steam generated in the steam generator; and a steam-guiding portion for delivering the steam from the steam generator to the steam eject port, and the steam ejection device further including a steam-heating block for heating, right before the steam eject port, the steam guided via the steam-guiding portion.

8 Claims, 13 Drawing Sheets

STEAM JETTING DEVICE

CROSS REFERENCE TO RELATED APPLICATIONS

This application is a U.S. national stage application of PCT/JP2007/052975 filed on Feb. 19, 2007, and claims priority to, and incorporates by reference, Japanese Patent Application No. 2006-104445 filed on Apr. 5, 2006.

TECHNICAL FIELD

The present invention relates to a steam ejection device for applying steam to a predetermined area of the human body, such as the face, head, etc.

BACKGROUND ART

Steam ejection devices (for example, Patent Document 1) have been widely known in the field of beauty machines or the like, as devices for applying steam to a predetermined area of the human body, such as the face, etc.

As shown in FIG. 5, the steam ejection device 110 includes a boiler 101 in which water is vaporized by heating; a nozzle 102 for ejecting steam generated in the boiler 101; a steam passage 103 for supplying steam from the boiler 101 to the nozzle 102; and a water-drop condensate pipe 104 connected to the steam passage 103. The nozzle 102 is provided in the middle of the vertical part of the water-drop condensate pipe 104. With this construction of the steam ejection device 110, if steam generated in the boiler 101 is condensed to water drops while passing through the steam passage 103, the water drops can be directed vertically downward through the water-drop condensate pipe 104. This prevents the water drops from reaching the nozzle 102 together with the steam.

Patent Document 1: Japanese Unexamined Patent Publication No. 2002-209971

DISCLOSURE OF THE INVENTION

Problems to be Solved by the Invention

In such a steam ejection device 110, however, steam supplied from the steam passage 103 into the water-drop condensate pipe 104 is condensed to water drops after being introduced in a branch passage 105 that is forked from the water-drop condensate pipe 104. Therefore, water drops generated in the branch passage 105 will reach the nozzle 102 with the steam to cause emission of the hot water drops from the nozzle 102 with the steam. Further, the discharged water drops problematically splash the area (e.g., the face, or the like) to be steamed.

The present invention has been made to solve the above problems, and aims to provide a steam ejection device capable of ejecting steam of high dryness.

Means for Solving the Problems

The object of the present invention is achieved by a steam ejection device including a steam-generating portion for generating steam by heating water; a steam eject port for ejecting the steam generated in the steam-generating portion; a steam-guiding portion for delivering the steam from the steam-generating portion to the steam eject port; and a steam-heating portion for heating, right before the steam eject port, the steam guided via the steam-guiding portion; the steam-generating portion including a steam-generating vessel; a steam-generating heating element for heating the steam-generating vessel by its heat; a steam-generating temperature-detecting means for detecting a temperature of the steam-generating vessel; a water-supplying means for supplying water to the steam-generating vessel; and a water supply control means controlling operation of the water-supplying means; and the water supply control means controlling a water supply amount of the water-supplying means based on the temperature detected by the steam-generating temperature-detecting means under a constant heat value of the steam-generating heating element.

It is preferable that the steam ejection device further include a base that horizontally rotatably supports the steam-generating portion, wherein the steam eject port is arranged to be able to rotate up and down relative to the steam-generating portion.

It is preferable that the steam ejection device further include a tube-like cover member extending from the steam eject port in the direction where the steam is discharged.

It is preferable that the steam eject port be rotatably constructed at the time of steam ejection.

Effects of the Invention

The steam ejection device of the present invention can discharge steam of high dryness.

EXPLANATION OF REFERENCE NUMERALS

Figure 1:
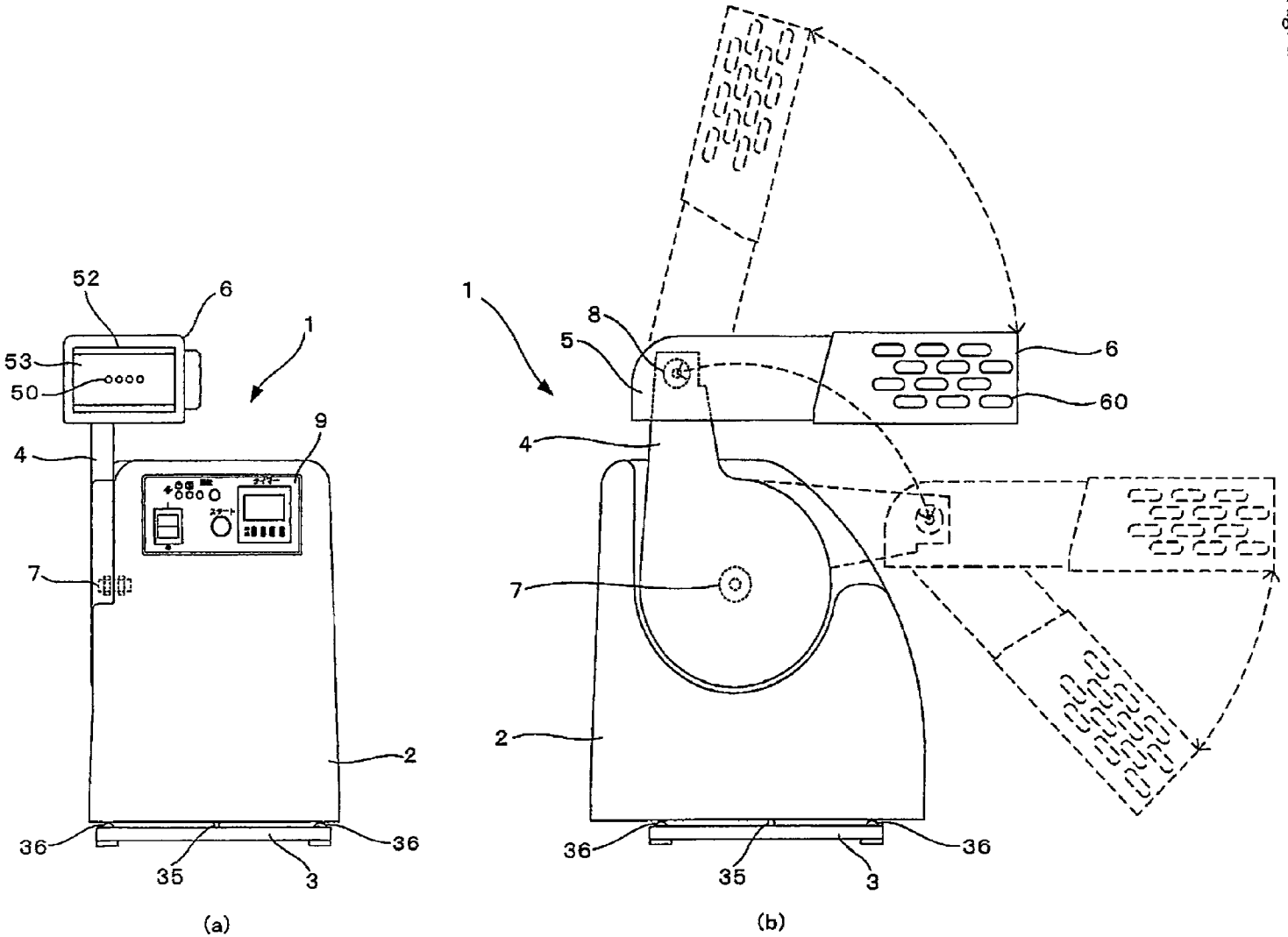
FIG. 1 is a view showing the entire construction of a steam ejection device according to one embodiment of the present invention.

1) steam ejection device
2) main body
3) base
4) arm
5) steam head
6) head cover
20) steam generator

21) steam-guiding channel
22) steam-generating vessel
25) water supply pump
26) steam-generating heating element
27) steam-generating temperature detector
28) water supply controller
50) steam eject port
53) steam-heating block

BEST MODE FOR CARRYING OUT THE INVENTION

Hereinafter, embodiments of the present invention are described with reference to the accompanying drawings. FIG. 1 shows the entire construction of a steam ejection device according to one embodiment of the present invention. FIG. 1(*a*) is the front view, and FIG. 1(*b*) is a side view.

As shown in FIG. 1, the steam ejection device 1 includes a main body 2 in which steam is generated; a base 3 horizontally rotatably supporting the main body 2; an arm 4 provided at a side of the main body 2, and a steam head 5 discharging the steam generated in the main body 2.

Provided in a front part of the main body 2 is a control panel 9 controlling a variety of operations, such as starting and stopping the steam ejection device 1. The base 3 includes rollers 36 placed along the circumference about the base axis 35, and rotatably supports the main body 2 disposed thereon by the rotation of rollers 36 about the base axis 35. The base end of the arm 4 is pivotally mounted to the main body 2 via the arm pivot 7, and thus the arm 4 is up- and downwardly rotatably held relative to the main body 2. The arm 4 is so configured that the position of the steam head 5 mounted to the end portion of the arm can be adjustably moved up and down by the rotation of the arm 4 about the arm pivot 7.

The base end of the steam head 5 is pivotally mounted via a head pivot 8 to the end portion of the arm 4, and thus the steam head 5 is up- and downwardly rotatably supported relative to the arm 4. The steam head 5 is so configured that the orientation against a vertical direction can be adjusted by the rotation of the steam head 5 about the head pivot 8. The steam head 5 provides a steam ejector 52 having a plurality of steam eject ports 50; and a tube-like head cover 6 covering around the steam ejector 52 at the end portion thereof. The head cover 6 is so arranged to extend from the end portion of the steam head 5 in the direction where the steam is discharged, so that the steam discharged from the steam ejector 52 is not applied to the human body at close range. The head cover 6 is preferably made of a light material such as a heat-resistant plastic, having heat resistance, a small specific heat, and poor heat conductivity. The head cover 6 is preferably transparent or semi-transparent so that the inside of the head cover 6 can be visually observed. Further, a plurality of vents 60 for letting the discharged steam out of the head cover 6 are formed on the lateral side of the head cover 6.

Figure 2:
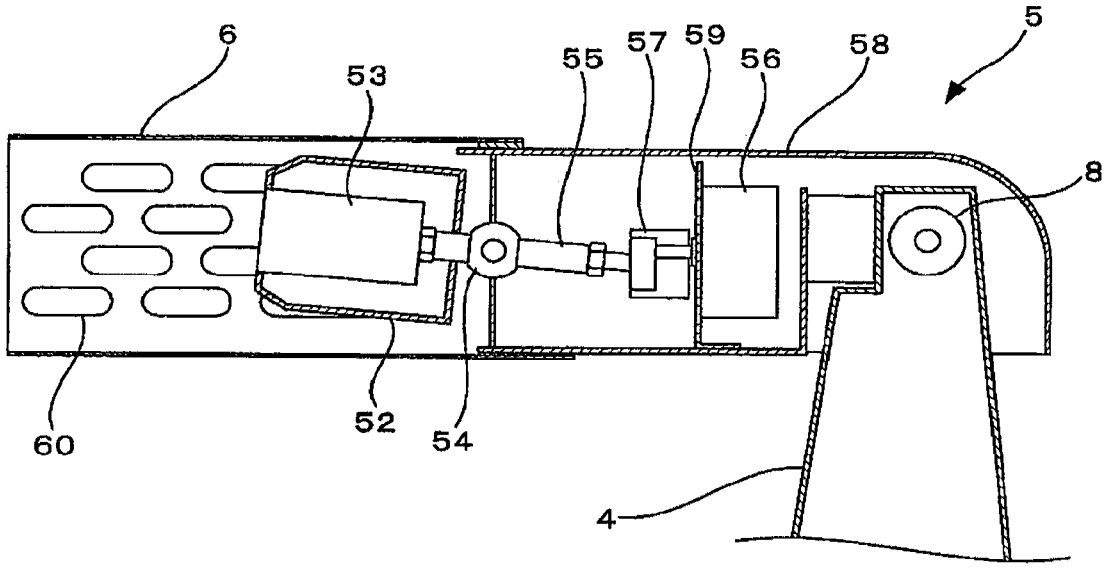
FIG. 2 is an enlarged sectional view showing a steam head of the steam ejection device shown in FIG. 1.

FIG. 2 is an enlarged sectional view of the steam head 5. As shown in FIG. 2, the steam head 5 includes a casing 58 pivotally mounted to the end portion of the arm 4; a support plate 59 disposed inside the casing 58 in a standing position; a drive motor 56 fixed to the support plate 59; an eccentric axis joint 57 mounted to the drive axis of the drive motor 56; an oscillating axis 55, the base end of which being coupled with the eccentric axis joint 57; and an oscillating bearing 54 supporting the oscillating axis 55. The end portion of the oscillating axis 55 is attached to the steam ejector 52. Via the eccentric axis joint 57, the drive axis of the drive motor 56 is connected to the oscillating axis 55 in such a manner that their axis lines are not aligned. The oscillating bearing 54 is oscillatably supported about pivot axes orthogonal via a gimbal mechanism. This oscillation allows the oscillating axis 55 to pivot about an oscillating bearing 54. The steam ejector 52 is configured such that the rotation of the oscillating axis 55 allows the steam ejector 52 to rotate, which allows the steam discharge direction to be pivotable. The steam ejector 52 includes a steam-heating block 53 therein.

The internal configuration of the steam ejection device 1 will now be explained with reference to FIG. 3. The steam ejection device 1 includes the steam generator 20 for generating steam by heating water; the steam-heating block 53 having the steam eject port 50 for ejecting the steam generated in the steam generator 20; and a steam-guiding channel 21 for transferring the steam from the steam generator 20 to the steam-heating block 53. In the present embodiment, the steam generator 20 is disposed inside the main body 2; the steam-heating block 53 is located inside the steam head 5, and the steam-guiding channel 21 is situated inside the arm 4.

The steam generator 20 includes a water supply tank 23 for containing water; the steam-generating vessel 22 for generating steam; a water-supplying pipe 24 for supplying water in the water supply tank 23 to the steam-generating vessel 22; a water supply pump 25 for delivering water from the water supply tank 23 to the water-supplying pipe 24; and a water supply controller 28 controlling the function of the water supply pump 25.

The steam-generating vessel 22 is made of, for example, aluminum or other materials having good heat conductivity. The steam-generating vessel 22 includes the steam-generating heating element 26 for heating the steam-generating vessel 22 by its heat; a steam-generating temperature detector 27 for detecting the temperature of the steam-generating vessel 22; and a steam-generating temperature fuse 29 preventing the steam-generating vessel 22 from raising its temperature too high. The steam-generating heating element 26 may be an electrical heater or the like, and is configured to provide constant heat consumption per unit time, and to be switchable between ON/OFF operations. Provided in the middle portion of the lid 30 is a steam outlet 31 for delivering the steam generated in the steam-generating vessel 22 to the steam-guiding channel 21.

The first end of the water-supplying pipe 24 is connected to the water supply tank 23; the second end is coupled with a spray nozzle 32 discharging water therefrom. The first end of the water-supplying pipe 24 is mounted to a filter 37 removing impurities contained in water. The end portion of the spray nozzle 32 projects toward the inside the steam-generating vessel 22.

Examples of the water supply pump 25 include a known electromagnetic pump configured such that a flow rate can be adjusted utilizing electromagnetic and spring forces.

The water supply controller 28 is connected to the steam-generating temperature detector 27, and is configured such that the amount of water to be supplied to the steam-generating vessel 22 can be adjusted by controlling the flow rate of the water supply pump 25 based on a detected temperature of the steam-generating temperature detector 27. Examples of control methods include a PID control that controls the flow rate of the water supply pump 25 based on a deviation between the set temperature and the detected temperature, and integral and differential values of the deviation.

The steam-heating block 53 is made of, for example, a material having good heat conductivity, such as aluminum. The block 53 includes a steam passage 72 therein; a steam inlet 74 introducing steam delivered through the steam-guiding channel 21 to the steam passage 72; and the steam eject port 50 for ejecting the steam out from the steam passage 72.

Further, the steam-heating block 53 includes a reheat-heating element 71 for heating the steam-heating block 53 by its heat; a temperature controller 77 controlling the temperature of the reheat-heating element 71; a reheat temperature detector 75 for detecting a temperature of the steam-heating block 53; and a reheat temperature fuse 73 preventing the temperature of the steam-heating block 53 from rising too high. It is preferable that the steam passage 72 wind, so as to provide the passage a long length. The temperature controller 77 is so configured that the temperature of the reheat-heating element 71 can be controlled based on the detected temperature of the reheat temperature detector 75.

One end of the flexible steam-guiding channel 21 is connected to the steam outlet 31; the other end is connected to the steam inlet 74.

A method for applying steam to the specified area of the human body, using the thus-prepared steam ejection device 1, will now be explained.

The main body 2 is horizontally rotated relative to the base 3, the arm 4 is up- and downwardly rotated relative to the main body 2, and the steam head 5 is up- and downwardly rotated relative to the arm 4. In this way, the direction that the steam is discharged is set in a desired state by adjusting the position and the orientation of the steam head 5 against the specified area of the human body.

Upon actuation of the control panel 9, a drive motor 56 is operated to rotate one end of the oscillating axis 55 around the drive axis of the drive motor 56 via an eccentric axis joint 57. The rotation of one end of the oscillating axis 55 allows the other end of the oscillating axis 55 to rotate about an oscillating bearing 54, allowing rotation of the steam ejector 52. In this way, the steam eject port 50 pivots at the time of steam discharge.

Next, upon reactuation of the control panel 9, the steam generator 20 is actuated, and the reheat-heating element 71 of the steam-heating block 53 is energized.

Figure 4:
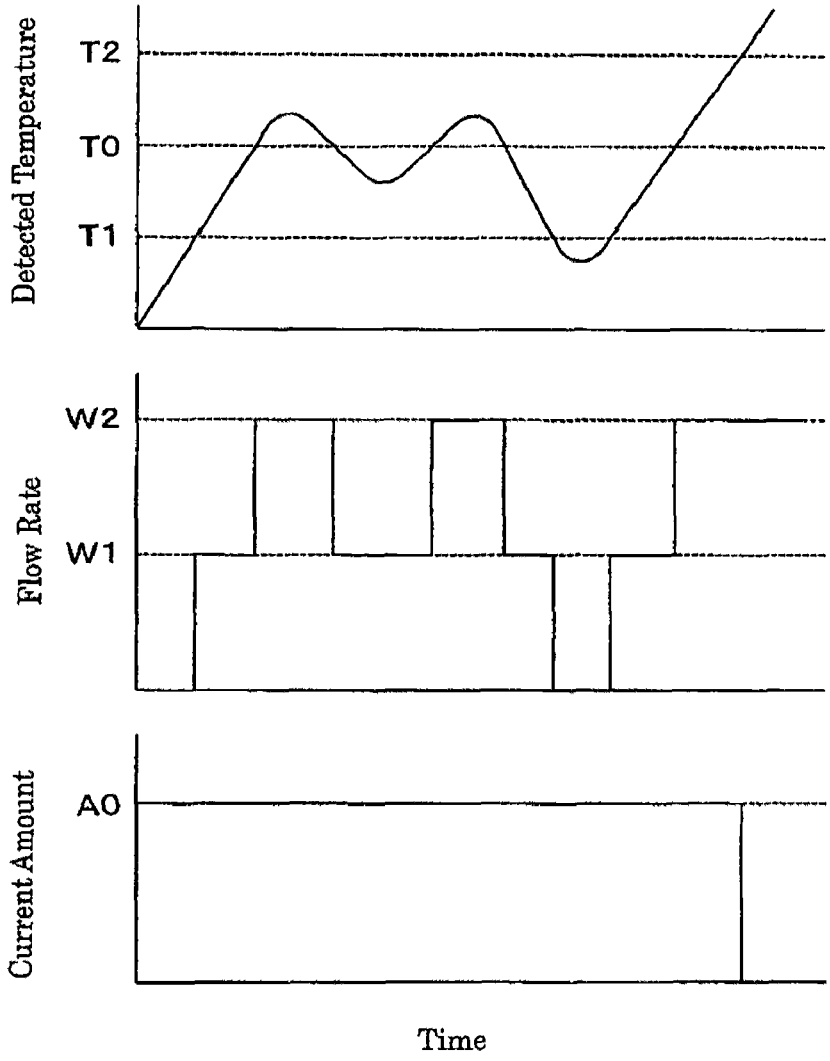
FIG. 4 is a graph showing one embodiment of water-supply control of the water supply controller in the steam generator as shown in FIG. 3.
Figure 5:
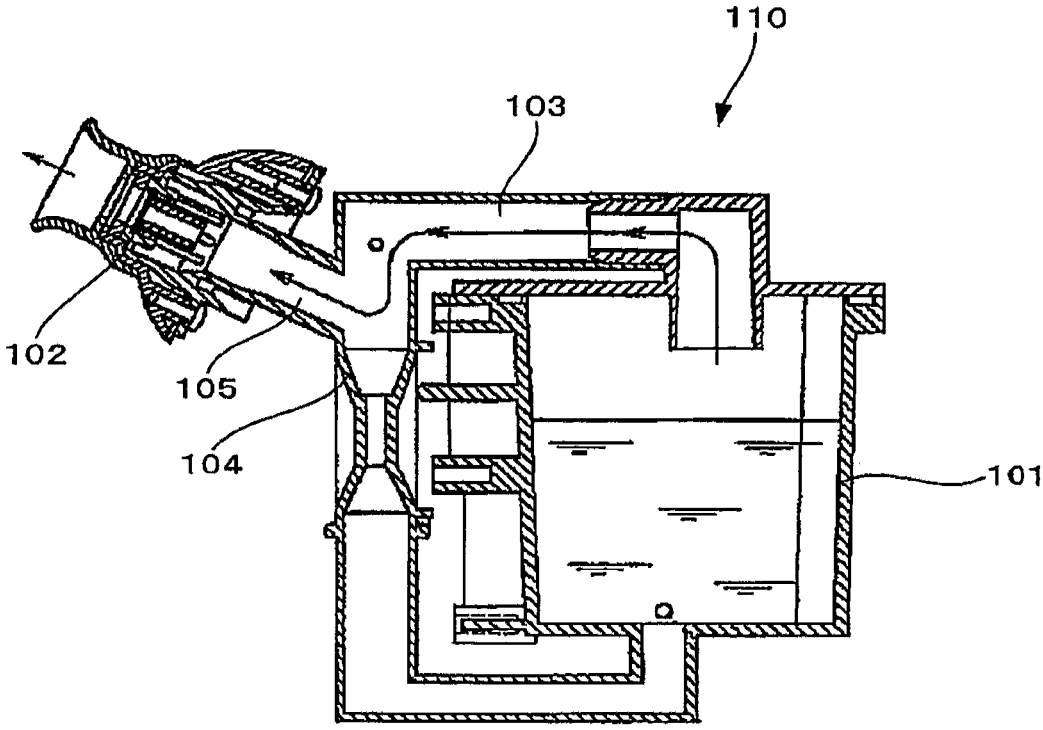
FIG. 5 is a sectional view showing the entire construction of a conventional steam ejection device.

When the steam generator 20 is activated, the steam-generating heating element 26 generates heat by energization to heat the steam-generating vessel 22. As shown in FIG. 4, since the steam-generating heating element 26 is electrified so as to have a constant heat value (current amount: A0), the temperature of the steam-generating vessel 22 rises with time.

On the other hand, the reheat-heating element 71 generates heat by energization of the reheat-heating element 71, to heat the steam-heating block 53 and the inside thereof (i.e., the steam passage 72). The temperatures of the steam-heating block 53 and the steam passage 72 are kept constant by controlling the temperature of the reheat-heating element 71 based on the detected temperature of the reheat temperature detector 75, using the temperature controller 77.

The temperature of the steam-generating vessel 22 in the steam generator 20 is detected by the steam-generating temperature detector 27. As shown in FIG. 4, when the detected temperature rises above the predetermined temperature (T1), the water supply controller 28 activates the water supply pump 25 (flow rate: W1). Upon actuation of the water supply pump 25, water in a water supply tank 23 is pumped out to the water-supplying pipe 24 so as to be discharged from the end portion of the water-supplying pipe 24, i.e., the spray nozzle 32, into the steam-generating vessel 22 in mist form. Water supplied to the steam-generating vessel 22 is vaporized by heat to generate steam.

After the actuation of the water supply pump 25, the water supply controller 28 regulates the flow rate of the water supply pump 25 based on the detected temperature of the steam-generating temperature detector 27. Specifically, as shown in FIG. 4, the water supply controller 28 increases the flow rate of the water supply pump 25 (flow rate: W2) to increase a water supply of the steam-generating vessel 22 when the detected temperature of the steam-generating temperature detector 27 rises above the predetermined temperature (T0). Further, when the water supply to the steam-generating vessel 22 is increased, the temperature of the steam-generating vessel 22 lowers. When the detected temperature of the steam-generating temperature detector 27 becomes lower than the predetermined temperature (T0), the flow rate of the water supply pump 25 is reduced (flow rate: W1) to decrease the water supply to the steam-generating vessel 22. In this way, the temperature of the steam-generating vessel 22 is substantially kept constant (T0), and water in the water supply tank 23 is constantly supplied into the steam-generating vessel 22. This allows for the continuous generation of steam from the steam-generating vessel 22. When the detected temperature of the steam-generating temperature detector 27 is further lowered to below the predetermined temperature (T1), the water supply controller 28 stops operation of the water supply pump 25. Further, when the detected temperature exceeds the predetermined temperature (T2), the steam-generating temperature fuse 29 inhibits energization to the steam-generating heating element 26, which stops heating of the steam-generating vessel 22.

The steam generated in the steam-generating vessel 22 is released from the steam outlet 31 of the lid 30 to the steam-guiding channel 21, and delivered to the steam-heating block 53 through the steam-guiding channel 21. The steam in the steam-guiding channel 21 is cooled while passing through the steam-guiding channel 21; some of the steam is condensed to liquid form, becoming a fluid mixture of steam and water.

The fluid mixture of steam and water delivered to the steam-heating block 53 is supplied into the steam passage 72 via the steam inlet 74, passes through the steam passage 72, and is then discharged from the steam eject port 50 to a predetermined area of the human body. The discharged steam passes through the head cover 6 and onto the human body.

In this case, while passing through the steam passage 72, the fluid mixture of steam and water is heated in the steam passage 72. Thereby, the water is reconverted to steam. In this way, steam of high dryness can be discharged from the steam eject port 50.

Since the steam ejection device 1 of the present embodiment includes the steam-heating block 53, in which the steam delivered via the steam-guiding channel 21 is heated right before the steam eject port 50, water drops can be vaporized by reheating the steam just before the steam is discharged. Thereby, steam of high dryness can be discharged. This prevents the predetermined part of the human body to which the steam was applied, such as the face and head, from getting wet. Further, the subcutaneous interior of the area can be sufficiently heated by applying the steam of high dryness and high heat energy to the particular area of the human body, such as the face and head. This increases blood flow, promoting blood circulation, and maintains the effects obtained thereby for a long time. Therefore, the device is particularly effective for a medical device application.

Further, since the water supply controller 28 controlling the flow rate of the water supply pump 25 based on the detected temperature of the steam-generating temperature detector 27 is provided, when the detected temperature of the steam-generating temperature detector 27 is lower than the predetermined temperature, the water supply controller 28 decreases the flow rate of the water supply pump 25, whereas when the detected temperature is higher than the predetermined temperature, the flow rate of the water supply pump 25 is increased to control the water supply of the steam-generating vessel 22. Thereby, continuous steam generation can be achieved. In this way, steam can be constantly applied to the predetermined area of the human body.

With the heating value of the steam-generating heating element 26 kept constant, the water supply controller 28 controls the flow rate of the water supply pump 25 on the basis of the detected temperature of the steam-generating temperature detector 27. Therefore, with the temperature of the steam-generating vessel 22 kept constant, steam can be constantly generated without changing the level of energization of the steam-generating heating element 26. Thereby, the heat of the steam-generating heating element 26 can be efficiently used.

The main body 2 is horizontally rotatably supported relative to the base 3, the arm 4 is up- and downwardly rotatably supported relative to the main body 2, and the steam head 5 is up- and downwardly rotatably supported relative to the arm 4. Therefore, the steam eject port 50 can be arranged in a desired position and orientation against the specific part of the human body to eject steam, by turning or rotating the main body 2, arm 4, or steam head 5. Further, the area to which steam is applied can be freely selected from a wide variety of areas of the human body.

The steam head 5 includes the tube-type head cover 6 covering around the steam eject port 50, and the head cover 6 is arranged to extend from the steam eject port 50 to the direction that steam is discharged. Therefore, the steam discharged from the steam eject port 50 passes through the head cover 6, and then reaches a given part of the human body. In this way, the steam can be applied to the human body in a safe manner.

Since the steam eject port 50 is configured so as to be rotatable at the time of steam discharge, the steam can be discharged to a wide area, rather than a concentrated area.

Although one embodiment of the present invention has been described herein, embodiments of the present invention are not limited thereto.

For example, though the steam generator 20 in the present embodiment is a drop-type steam generator, in which water is discharged in mist form from the spray nozzle 32 into the steam-generating vessel 22, the configuration thereof is not limited as long as steam can be generated. For example, a known boiler-type steam generator is usable. In this case, the steam generator 20 includes a boiler for containing water, and a boiler-heating means for heating the boiler (not shown).

The steam ejection device 1 may be a timer-type device, and configured to constantly discharge steam during a certain period of time set using a timer. In this case, the control panel 9 includes a timer switch (not shown), and the steam generator 20 constantly operates for periods set by the timer switch. After a set period, the steam discharge operation from the steam eject port 50 is stopped. Further, the steam eject port 50 may be configured to be rotatable by actuation of the drive motor 56 for the periods set using the timer.

The method in which the water supply controller 28 controls a flow rate of the water supply pump 25 is not particularly limited. For example, the flow rate can be controlled by changing an applied voltage based on the detected temperature, utilizing a water supply pump capable of controlling a discharge amount depending on a voltage level to be applied. Further, the flow rate can be controlled by a frequency change utilizing a water supply pump capable of controlling a discharge amount based on a frequency of an applied voltage. Further, a plurality of water supply pumps, each having a different discharge amount, can be used to control the flow rate. Specifically, any one of the water supply pumps can be selected based on the detected temperature to control the flow rate.

Although the water supply controller 28 of the present embodiment controls the water supply to the steam-generating vessel 22 by controlling the flow rate of the water supply pump 25, the configuration thereof is not limited, as long as a water supply to the steam-generating vessel 22 can be adjusted. A plurality of flow channels, each having a different diameter, can be connected to the water supply pump 25; any one of the flow channels can be selected by the water supply controller 28 based on the detected temperature to control the water supply of the steam-generating vessel 22.

The heating value of the steam-generating heating element 26, the content of the steam-generating vessel 22, the diameter of the steam outlet 31, the flow rate of the water supply pump 25, and the setting temperature, which is an integer to control the flow rate of the water supply pump 25, are all suitably changeable. The setting temperature, which is an integer to control the water supply pump 25, may be set by the control panel 9 ahead of time, or each time the steam generator 20 is operated.

EXAMPLES

Example 1

Relaxation Effects of the Steam Ejection Device with Reference to Changes in the Immune Antibody Content of Salivary Immunoglobulin A (S-IgA)

In the examination, relaxation effects obtained by the facial steam treatment using the steam ejection device were evaluated with respect to the immunoglobulin A: S-IgA (immune antibody content in saliva).

1. Examination Method

Fourteen healthy adult females aged 20 to 28 were employed as subjects.

Before examination, subjects had medical checkups. Explanations were given to the subjects so as to obtain their informed consent.

The examination consisted of two parts: a preliminary examination and a main examination. The preliminary examination was carried out under conditions in which no particular skincare other than usual skincare was performed. S-IgA was measured a total of 20 times (twice in the morning and twice in the afternoon, over five days) to evaluate a normal value and intraindividual variability. Thereafter, steam was applied to the subject's face using the steam ejection device at a certain time set for each subject, and S-IgA was then measured.

A blind method was employed, wherein information on the purpose of the examination, the contents and performance of the products to be used in the examination, etc., was withheld from the individual subjects.

Body condition was evaluated according to the following.

(1) Subjects do not undergo daily pharmacological therapy (including the use of traditional Chinese medicine) during the examination period.

(2) Subjects do not currently have a mental problem.

(3) Subjects do not have a smoking habit.

(4) Subjects do not drink alcohol excessively during the examination period.

(5) Except for regular movement, subjects do not perform excessive exercise during the examination period.

(6) Subjects have a regular sleeping pattern, and are not long sleepers or short sleepers.

(7) Subjects generally have three meals a day, and are not on a diet.

(8) Subjects are not currently undergoing dental treatment.

(9) Subjects have a regular cycle, and are not pregnant.

2. Examination Item and Method (1) Immunoglobulin A: S-IgA

The immunoglobulin A: S-IgA (hereinafter, S-IgA) was evaluated in the examination.

Secretory S-IgA, an immune antibody contained in saliva, is one of the humoral immune substances, and has a molecular weight of 390,000.

S-IgA is covered with a secretory component made of a peptide with a molecular weight of 50,000 to 60,000, so as not to be melted by a protein-degrading enzyme in mucus.

S-IgA helps to neutralize foreign substances such as bacterium in mucus that covers generalized mucous systems such as the mouth, digestive tract, or the like. An increase in S-IgA indicates that the immune system, which is the bio-defense system, reacts primarily to stress.

In particular, S-IgA contained in saliva has been relatively easily detected since the 1990s, and is thus used as a stress reaction indicator in the psychoimmunology field. Further, studies in which effects of a variety of therapies were evaluated concluded that a significant increase in salivary S-IgA indicated stress reduction and relaxation effects.

(2) Method for Measuring S-IgA

S-IgA was measured in the following manner. Saliva samples were first collected from subjects at rest in a sitting position, and then facial steam treatment was carried out using the steam ejection device for 15 minutes. Three minutes after completion of the treatment, saliva samples were collected again. The change in S-IgA content after the steam treatment was quantified with reference to the initial value.

The normal value of each subject's S-IgA was determined on the basis of the analytical value of the S-IgA obtained in the preliminary examination, considering intraindividual variability.

The examination and S-IgA measurement were conducted in consideration of the time when the subject's S-IgA level is most stabilized.

(3) Ejection Condition and Procedure of the Steam Ejection Device

1) The steam was applied to the subject's face in a position about 40 cm away from the steam eject port of the steam ejection device with the subject at rest in a sitting position.

2) With respect to the ejection condition, one treatment set consisted of a five-minute facial steam treatment followed by a recess of about one minute. Three sets of treatments (15 minutes of facial steam treatment in total) were performed a day. The treatment was carried out once every day for 40 days.

3) The steam temperature for the face was about 37.0±1.0° C. The steam dryness at the steam eject port was about 0.98.

4) The state of health was based preliminary on subjective symptoms. When excessive fatigue or mental stress appeared, the steam treatment was canceled according to the subject's own judgment.

(4) Face Stimulation by Massage and Hot Pack

For comparison with the relaxation effects obtained by the steam ejection device, the subject underwent the steam treatment using the steam ejection device, a massage treatment, and a hot pack treatment each for three days.

Each stimulation treatment was assayed at an interval of at least three days.

One massage treatment set consisted of a five-minute facial massage based on a Chinese pushing massage method, followed by a one-minute recess. Nine such massage treatment sets were conducted a day, with a total of 27 treatment sets conducted over three days.

One hot pack treatment set consisted of a five-minute facial towel pack treatment (at about 39° C.), followed by a one-minute recess. Nine such hot pack treatment sets were conducted a day, with a total of 27 treatment sets conducted over three days. The towel was replaced every minute to keep the temperature of the face constant.

3. Examination results (1) Results of Preliminary Examination

S-IgA was measured a total of 20 times (including mornings and afternoons over five days), and evaluated. The results reveal that all subjects have a circadian S-IgA change within 5% of the mean value.

The S-IgA levels of the individual subjects slightly vary depending on the time period, showing the individual character of the subjects.

(2) Temporal Changes in S-IgA after the Facial Steam Treatment of the Steam Ejection Device Immediately after the completion of the facial steam treatment using the steam ejection device, S-IgA values of seven subjects were analyzed every minute. As a result, S-IgA decreased one minute after treatment, compared to before the treatment.

After a lapse of two minutes, however, S-IgA slightly increased, compared to before the treatment.

From the third minute, S-IgA rose significantly, maintaining its level until the fifth minute. Therefore, saliva samples were collected three minutes after completion of the facial steam treatment using the steam ejection device.

(3) Relaxation Effects with Reference to S-IgA Obtained in each of the Face Stimulation Treatments Three types of face stimulation treatments, including the steam ejection device treatment, were performed on 12 subjects, and relaxation effects obtained thereby were measured in view of S-IgA.

For the steam ejection device treatment, S-IgA increased 6.7%, from 197 (the value before the ejection) to 211.

For the Chinese massage method, S-IgA increased 2.1%, from 195 (the value before the stimulation) to 199.

For the hot pack treatment, S-IgA increased 4.5%, from 193 (the value before the hot pack treatment) to 202.

The results revealed that the facial treatment using the steam ejection device showed the largest increase in S-IgA, causing high relaxation effects.

(4) Changes in S-IgA Obtained in the Facial Steam Treatment Using the Steam Ejection Device over 40 Days The change rate of S-IgA obtained three minutes after the facial steam treatment to S-IgA obtained before the treatment using the steam ejection device was measured. As a result, a rise of 6.9% was observed on the first day of the examination. Thereafter, a slight tendency to increase was gradually observed (on the $5^{th}$ day, 7.3%; on the $10^{th}$ day, 7.7%; and on the $15^{th}$ day, 9.9%); however, no significant difference was observed.

On the $20^{th}$ day, a significant increase (11.6%) was observed, and the significant increase (over 10%) was constantly observed up to the $40^{th}$ day. This indicates that the significant relaxation effects, in view of S-IgA, of the facial steam treatment using the steam ejection device are achieved by continuing the daily steam treatment (at least 15 minutes a day) for 20 days.

Figure 6:
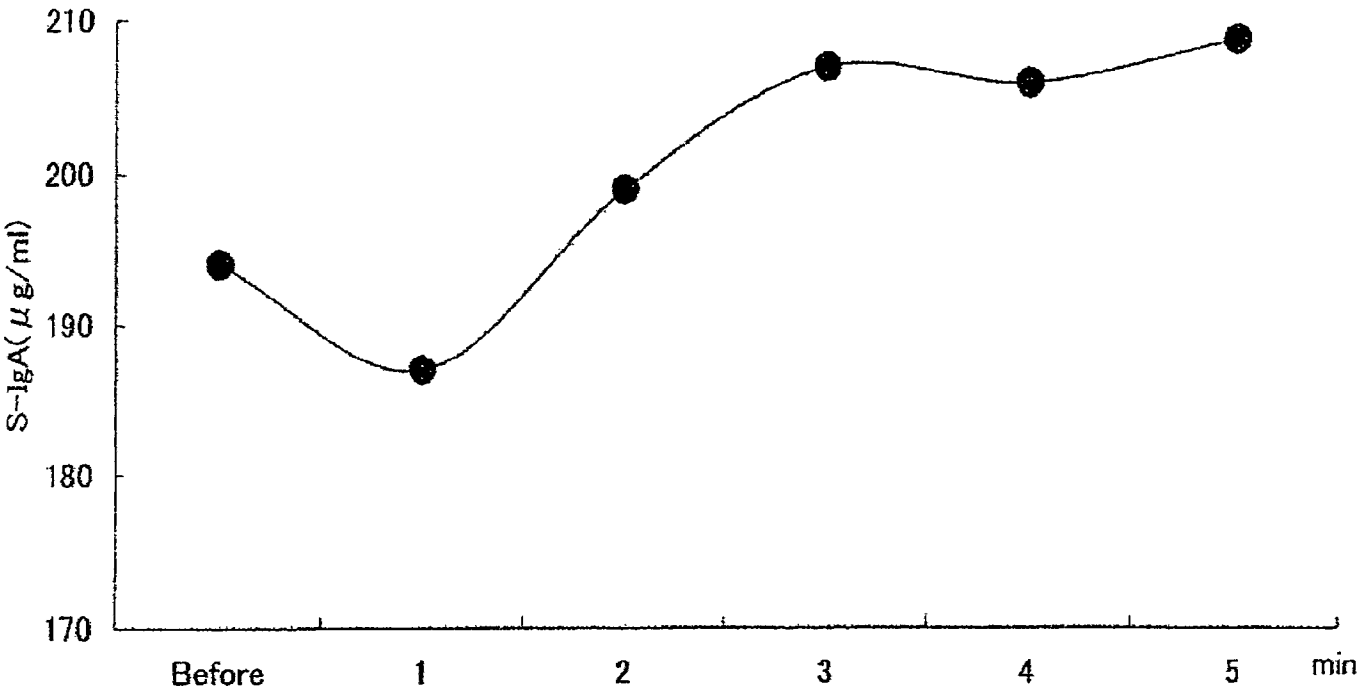
FIG. 6 is a graph showing changes with time in S-IgA in Example 1.

FIG. 6 shows temporal changes in S-IgA after the facial steam treatment of the steam ejection device.

Figure 7:
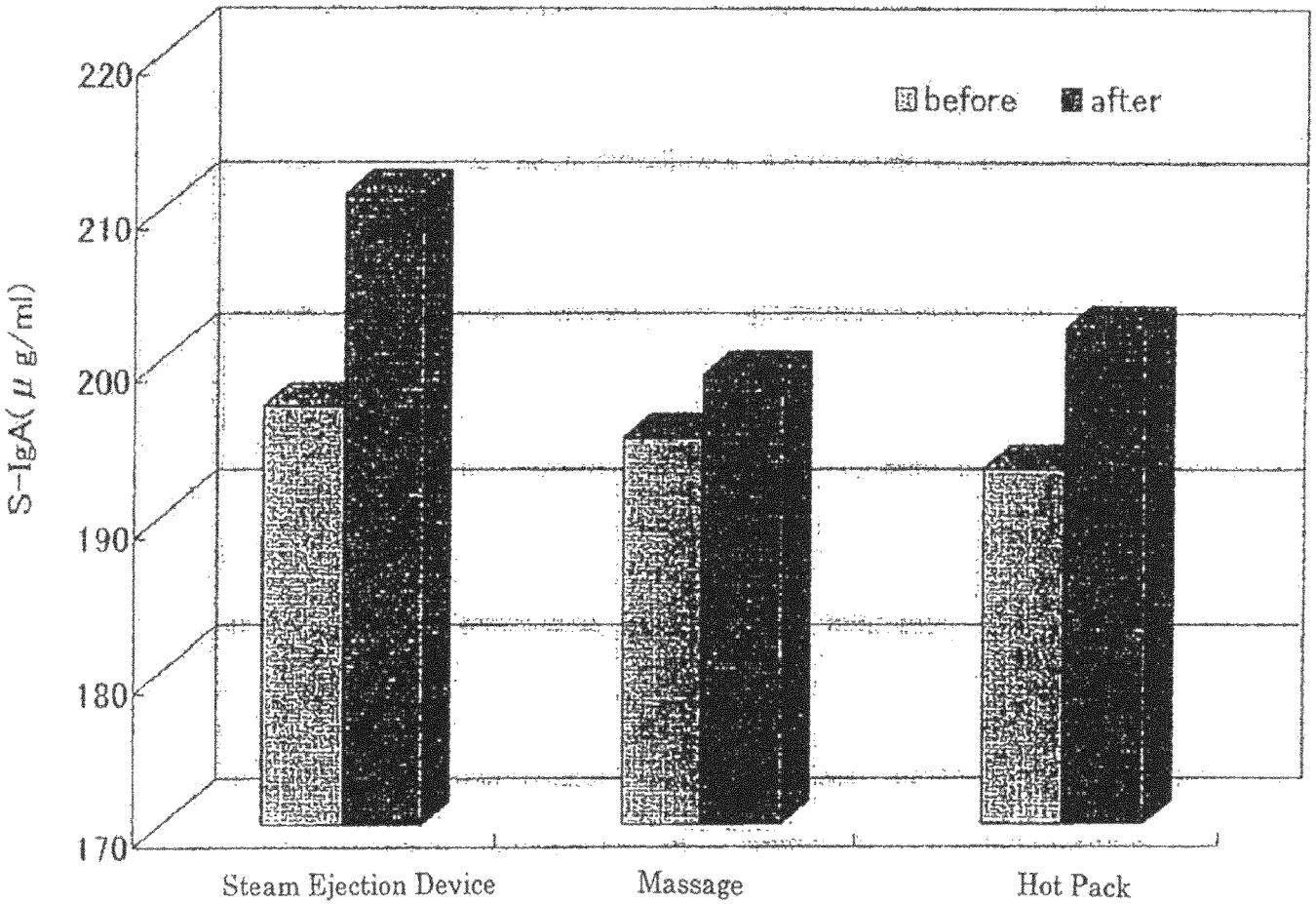
FIG. 7 is a graph showing relaxation effects obtained in Example 1.

FIG. 7 shows the relaxation effects with respect to the S-IgA obtained in the face stimulation treatments. Twelve healthy adult females aged 20 to 36 were employed as subjects. Changes in S-IgA between before and after face stimulation treatments were detected to evaluate the relaxation effects. The face stimulation treatments were conducted under the following condition. Each treatment consisted of a five-minute treatment and a one-minute recess (one set), and 27 treatment sets were conducted for three days. The mean value of S-IgA over three days was then determined. The results revealed that the steam ejection device treatment showed the largest increase in S-IgA, and achieved high relaxation effects.

Figure 8:
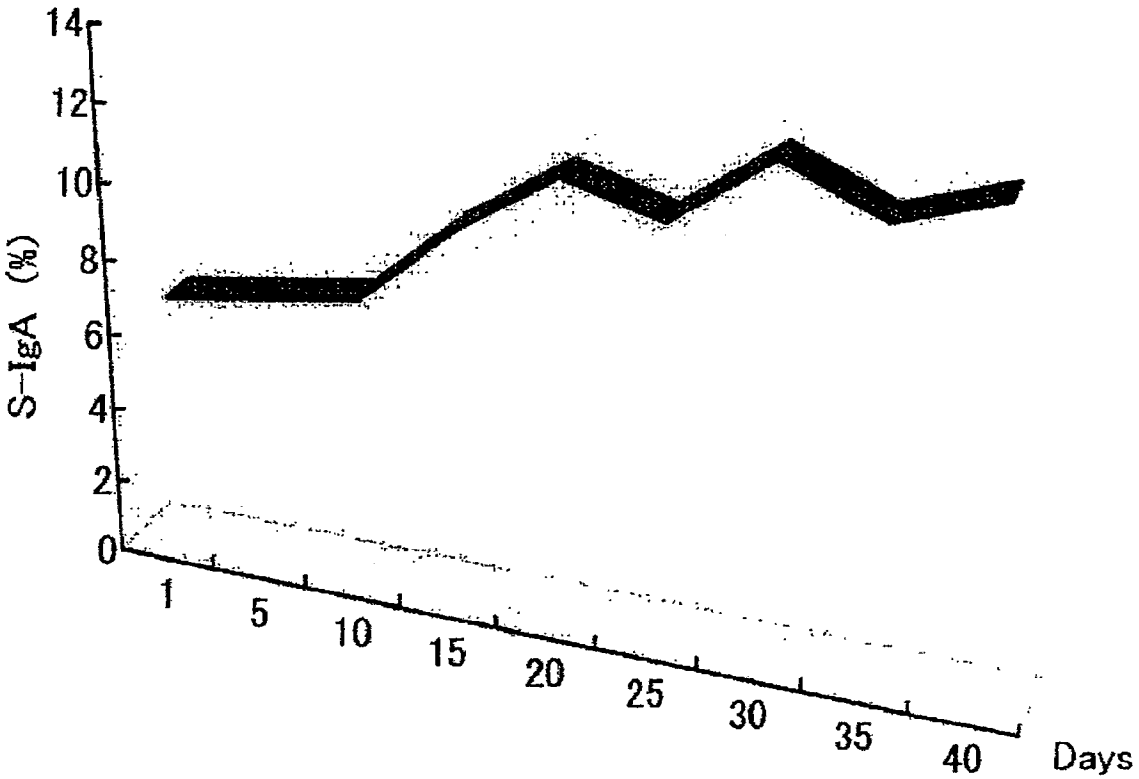
FIG. 8 is a graph showing a change rate of S-IgA in Example 1.

FIG. 8 shows a S-IgA change rate obtained in the facial steam treatment using the steam ejection device. Fourteen subjects (females, aged 20 to 36) participated in the examination. Relaxation effects were evaluated in view of the change rate (%) of S-IgA obtained three minutes after completion of the treatment (5 min.×3) to the S-IgA obtained before the treatment of the steam ejection device. Three five-minute steam ejection device treatment sets were conducted daily, and the change rate was measured every five days until the $40^{th}$ day of the treatment. The results showed a significant change in S-IgA on the $20^{th}$ day. Though the relaxation effects of the steam ejection device can be achieved on the first day of the treatment, continued treatment for 20 days results in remarkable relaxation effects. The relaxation effects, in view of S-IgA, can be deduced from a 10% increase in S-IgA, relative to the value before the facial treatment using the steam ejection device.

Example 2

Effects of Steam Treatment using the Steam Ejection Device on Body's Active Oxygen 1. Purpose of the Examination Removal effects on body's active oxygen attained by the facial steam treatment using the steam ejection device were evaluated in view of hydroperoxide.

2. Examination Method

Twenty-four healthy adult females aged 20 to 36 were employed as subjects.

Before examination, subjects had medical checkups. Explanations were given to the subjects so as to obtain their informed consent.

In the examination, the subjects were randomly assigned to two groups: a group in which a facial steam treatment was conducted using a steam ejection device (12 subjects), and a group in which nothing was performed (12 subjects).

A blind method was employed, wherein information on the purpose of the examination, the contents and performance of the products to be used in the examination etc. was withheld from the individual subjects.

Body condition was evaluated according to the following.

(1) Subjects do not undergo daily pharmacological therapy (including the use of traditional Chinese medicine) during the examination period. Subjects do not take vitamins such as tocotrienols.

(2) Subjects do not currently have a mental problem.

(3) Subjects do not have a smoking habit.

(4) Subjects do not drink alcohol excessively during the examination period.

(5) Except for regular movement, subjects do not perform excessive exercise during the examination period.

(6) Subjects have a regular sleeping pattern, and are not long sleepers or short sleepers.

(7) Subjects generally have three meals a day, and are not on a diet. Subjects consume as few SOD-containing foods as possible.

(8) Subjects are not currently undergoing dermatology treatments for dermatologic disorders or the like.

(9) Subjects have a regular cycle, and are not pregnant.

3. Examination Items

Active Oxygen in Living Body (Free Radical)

During the examination, active oxygens, lipids affected by peroxidation damage via free radicals, proteins, amino acids, and hydroperoxides with denatured nucleic acids were examined.

Therefore, the value of active oxygen obtained in the present examination was defined by a given unit U.CARR (Carr), which demonstrated the total value of super oxides, hydrogen peroxides, hydroxyl radicals, etc.

4. Analytical Method

FRAS (Free Radical Analytical System) was used. Measurement methods have mainly used ESR (electron spin resonance) devices. In the devices, electron spins of a sample are trapped, and the spin resonance is analyzed to detect free radicals. However, the measurement takes a long time, making it difficult to evaluate a variety of samples. In the current examination, the damaging results of proteins, lipids damaged by active oxygen in the body, etc. were accurately evaluated in a short period of time, with a small blood sample collected, using FRAS. Thereby, the active oxygen content of the subject was quantified.

5. Examination Process (1) Individual Character and Circadian Change

The normal value and circadian change of the active oxygen were first measured to determine the individual character of the subject.

(2) Ejection Condition and Procedure of the Steam Ejection Device

Facial treatment using the steam ejection device was conducted on the subject in the following manner.

1) Steam was applied to the subject's face in a position about 40 cm away from the steam eject port of the steam ejection device, with the subject at rest in a sitting position.

2) With respect to the ejection condition, one treatment set consisted of a five-minute facial steam treatment followed by a recess of about one minute. Three sets of treatments (15 minutes of facial steam treatment in total) were performed a day. The examination continued for three months. The treatment was carried out three to four times a week, with a total of 45 treatment sets conducted over 30 days.

3) The steam temperature for the face was about 37.0±1.0° C. The steam dryness at the steam eject port was about 0.98.

4) The state of health was based primarily on subjective symptoms. When excessive fatigue or mental stress appeared, the steam treatment was canceled according to the subject's own judgment.

(3) Active Oxygen Measurement Method

The active oxygen measurement was conducted on the individual subjects before the treatment using the steam ejection device. Then, the active oxygen obtained 30 minutes after completion of the steam treatment was measured again.

The active oxygen was measured every two weeks for 12 weeks.

The measurement was conducted during waking hours at the time when the active oxygen obtained in the preliminary examination was at the highest level, in consideration of the circadian change of the subject's active oxygen.

(4) Active Oxygen Analyzation Method

A blood sample (20 μml) was collected from the subject's fingertip using a catheter.

The collected blood sample was added to a buffer solution of pH 4.8, and replaced into a cuvette. Chromogen was added thereto, mixed, and then centrifuged.

Thereafter, hydroperoxide molecules were detected using a spectrophotometer.

6. Examination Result

With reference to the initial value obtained before the facial treatment using the steam ejection device, the steam ejection device group was 258 U.CARR, and the control group was 254 U.CARR.

A significant difference was not observed therebetween.

Two weeks later, the active oxygen of the steam ejection device group was 264 U.CARR, and no significant change was observed over the initial value.

Up to and including the $8^{th}$ week, no significant difference over the initial value was observed.

Ten weeks later, the active oxygen of the steam ejection device group was 231 U.CARR, a significant drop from the initial value.

Twelve weeks (three months) later, the device group further dropped significantly to 222 U.CARR.

The control group was almost the same level as the initial value until the $12^{th}$ week, showing no significant difference.

The examination revealed that active oxygen removal effects obtained by the facial treatment using the steam ejection device were attained by continuing the steam treatment over 10 weeks, with 15-minute treatments conducted three or four times a week.

Figure 9:
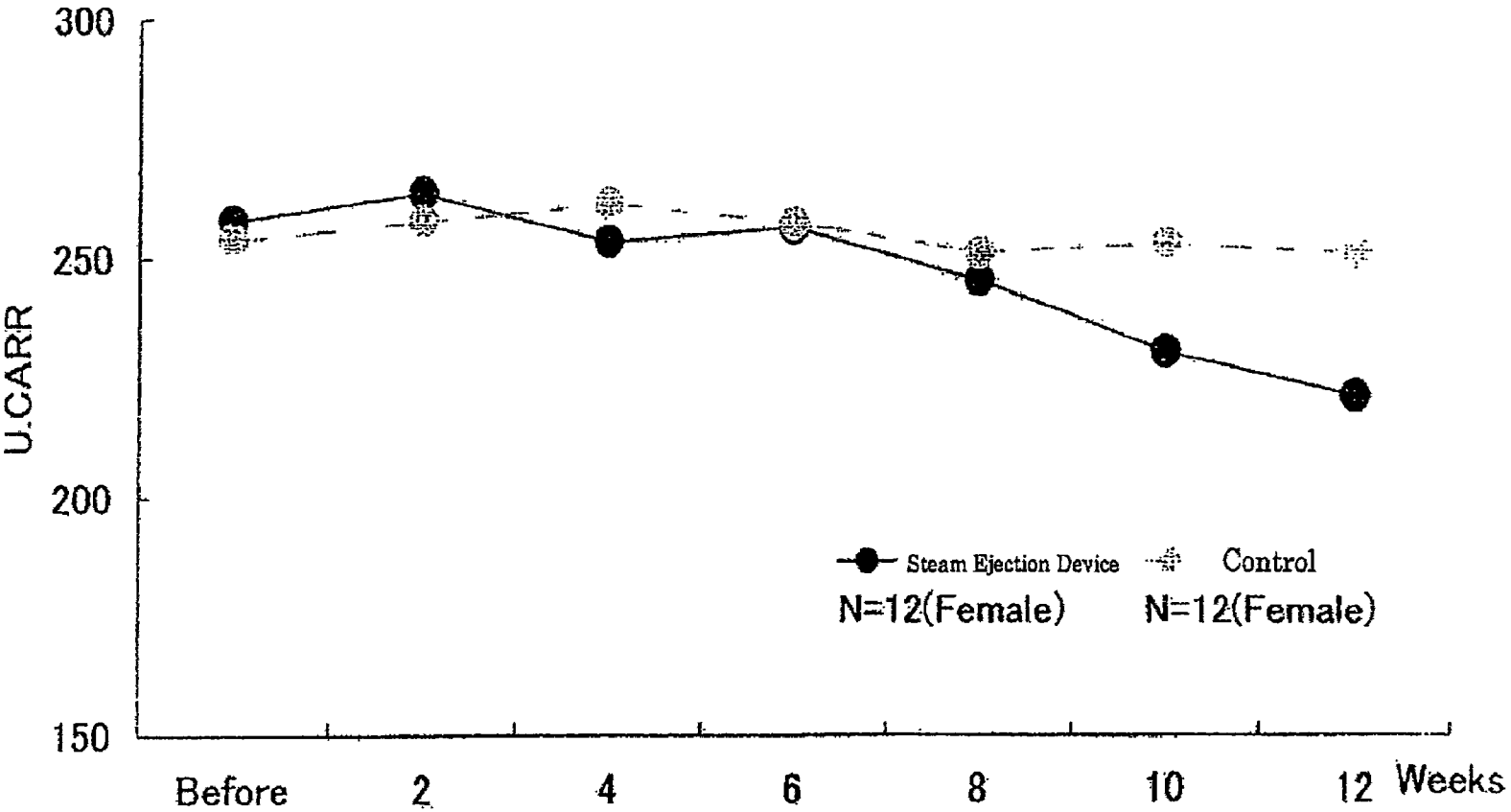
FIG. 9 is a graph showing changes in active oxygen in Example 2.

FIG. 9 shows changes in active oxygen obtained by the steam ejection device facial treatment. The facial treatment (5 minutes×3 times) using the steam ejection device was conducted three or four times a week over three months on 24 healthy adult females aged 20 to 36 (steam ejection device: 12 subjects, control: 12 subjects), and changes in active oxygen were measured. As a result, the steam ejection device group showed a significant drop in active oxygen, compared to the control, ten weeks after the start of the examination, and a further significant drop 12 weeks after the start of the examination.

Figure 10:
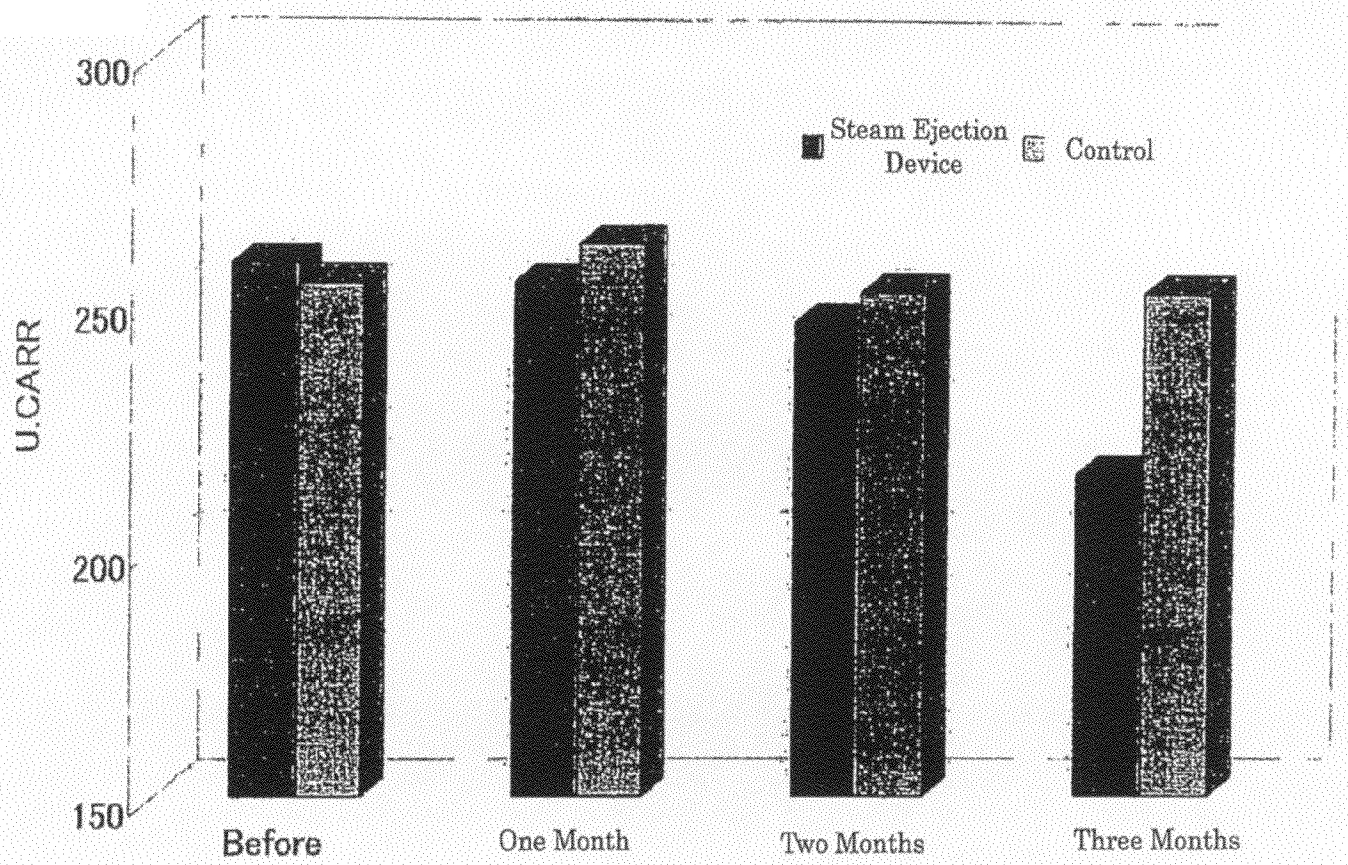
FIG. 10 is a graph showing monthly changes in active oxygen in Example 2.

FIG. 10 shows monthly changes in active oxygen obtained in the steam ejection device facial treatment.

Example 3

Effects of Steam Ejection Device with Reference to a Cerebral Blood Circulation State During the examination, a peripheral vessel blood flow and a cerebral blood circulation state were evaluated to analyze the effects obtained by the steam ejection device.

1. Method (1) Subjects

Twenty healthy adult females were employed as subjects. The ages ranged from 19 to 22.

Subjects had medical checkups. Explanations were given to the subjects so as to obtain their informed consent for the examination.

Backgrounds of the subjects were as follows. Use of daily special cosmetics was limited. Subjects were confirmed not to be under pharmacological therapy, or the like. Subjects were further confirmed by self-reported information not to suffer from chronic insomnia.

Subjects were checked to determine if they had a regular cycle, and were not pregnant.

(2) Examination Method

The steam was applied to the subject's face in a position about 40 cm away from the steam eject port of the steam ejection device, with the subject at rest in a sitting position.

Regarding the ejection condition, one treatment set consisted of a five-minute facial steam treatment followed by a one-minute recess.

Three such treatment sets were performed a day. Sixty treatment sets were continually performed over a period of 20 days.

The steam temperature for the face was an average of 37.0±1.2° C. The steam dryness at the steam eject port was about 0.98.

For health management of the subject, the end of the steam treatment was reported according to the subject's own judgment, considering fatigue and the mental condition of the subject.

Before the examination, 20 subjects were randomly assigned into two groups A and B, each group having ten subjects.

The examination was conducted using a crossover approach. In A group, facial treatment using the steam ejection device was conducted for 20 days, after which ordinal facial skincare was then performed for 10 days as control. In B group, the control treatment was first conducted for 10 days, after which the facial treatment using the steam ejection device was conducted for 20 days.

The cerebral blood circulation state was evaluated twice; before using the steam ejection device, and after conducting 60 treatment sets, i.e., 20 days later.

While three steam ejection device treatment sets were conducted, changes in peripheral vessel blood flow were recorded over 17 minutes including time for recess.

The cerebral (transcranial) blood volume was continuously recorded for 240 seconds (four minutes) immediately after completion of the three treatment sets using the steam ejection device.

A blind test method was employed wherein no information on the purpose and the products of the examination was given to the individual subjects.

(3) Examination Items

1) StO2 (tissue oxygen saturation)
2) Total hemoglobin content
3) OxyHb (oxygenated hemoglobin)
4) DeoxyHb (deoxygenated hemoglobin)
5) Peripheral vessel blood flow In the examination, a device for measuring cerebral oxygen saturation and the total hemoglobin content was used with a near-infrared spectroscopy method. A muscle and transcranial brain sensor (psp 20×50) was applied to the area for measuring the tissue oxygen saturation and hemoglobin content, i.e., the left forehead. The measurement was then conducted using a near-infrared spectroscopy method.

According to the present examination method, the StO2 and Hb of the brain covered with the skull, and of muscle tissues far from the skin's surface, were continuously recorded together in a bloodless manner based on the theoretical formula using an absorptiometric method.

2. Results

A comparison of the subject mean values revealed that the steam ejection device showed a high level in all four items including StO2, total hemoglobin content, OxyHb content, and DeoxyHb content, in comparison with those of the control.

The results revealed that the facial steam treatment using the steam ejection device increased cerebral blood flow, promoting blood circulation.

Similarly, the steam ejection device showed a significantly higher peripheral vessel blood flow than the control group.

Figure 11:
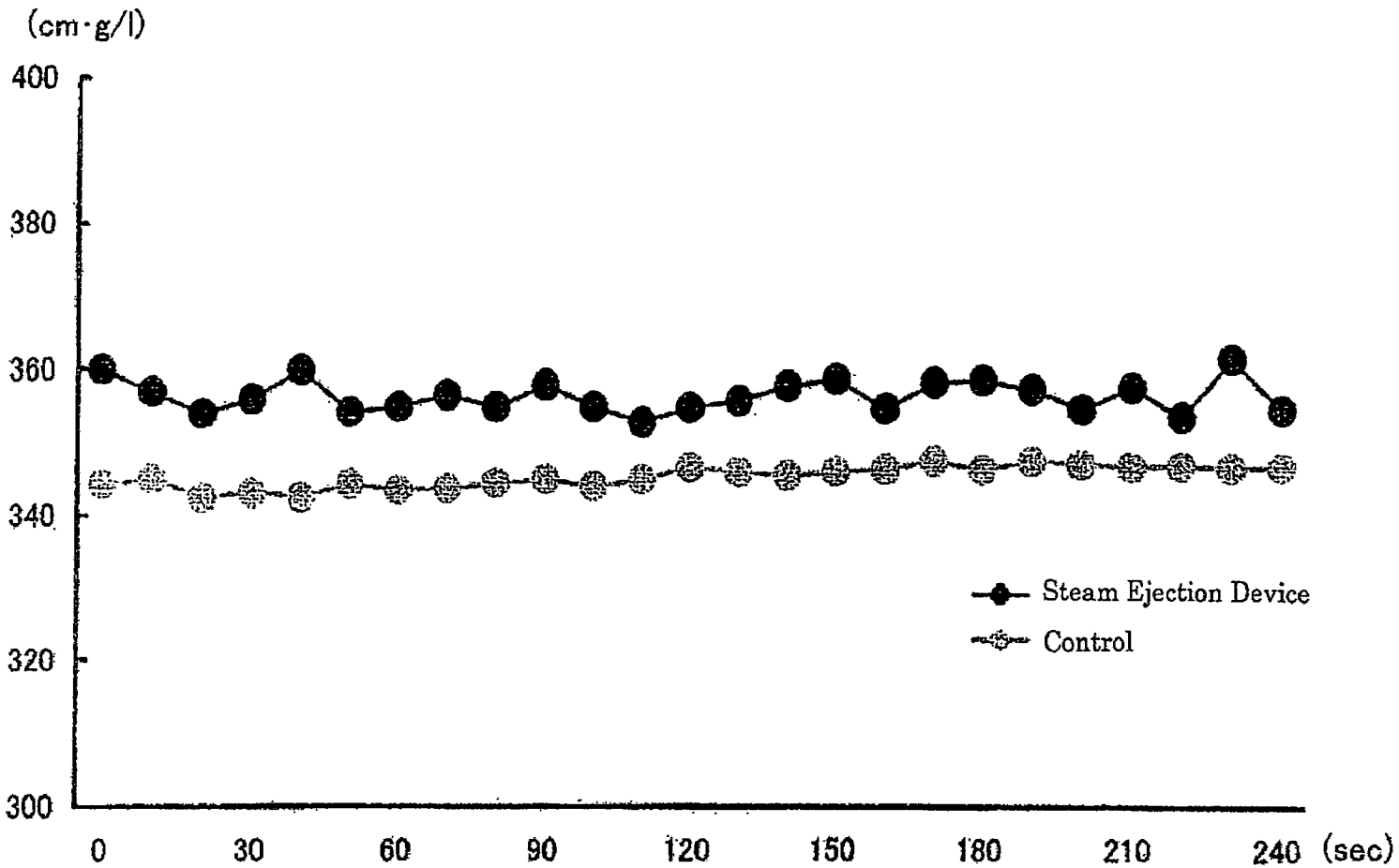
FIG. 11 is a graph showing temporal changes in the total amount of hemoglobin obtained in Example 3.

FIG. 11 shows temporal changes in total Hb (total hemoglobin content) obtained by use of the steam ejection device. Twenty healthy adult females were employed as subjects. Steam of the steam ejection device was applied to the face three times a day (5 min.×3) for 20 days. The total cerebral hemoglobin contents were quantified by a near-infrared spectroscopic method. As a result, the steam ejection device group showed a significant increase in total cerebral hemoglobin content, compared to the control group. This result likely indicates that the cerebral blood volume is increased as a result of the steam treatment using the steam ejection device.

Figure 12:
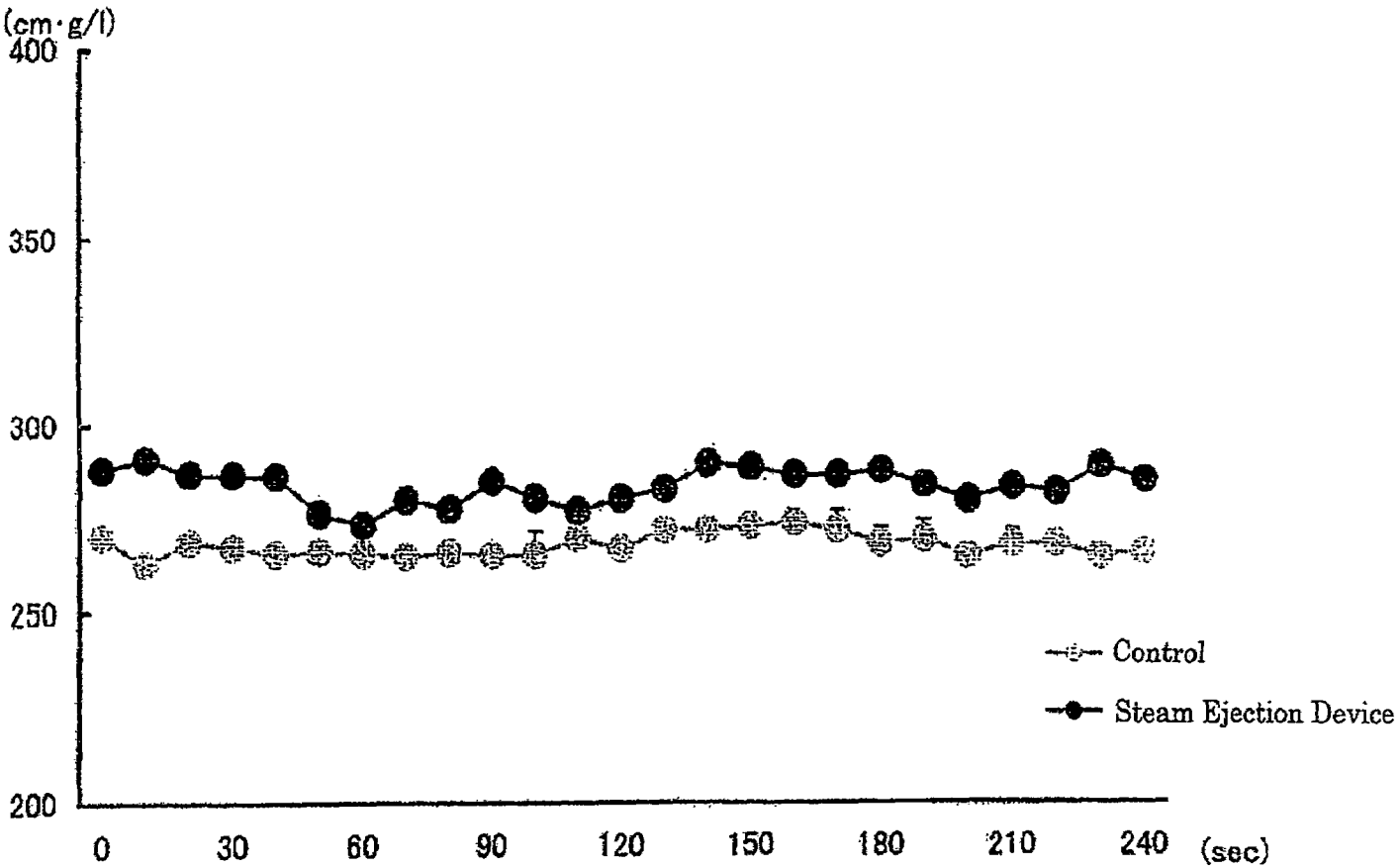
FIG. 12 is a graph showing temporal changes in the amount of oxygenated hemoglobin obtained in Example 3.

FIG. 12 shows temporal changes in OxyHb (oxygen hemoglobin content) obtained by use of the steam ejection device. Twenty healthy adult females were employed as subjects. Three facial steam treatment sets (5 min.×3) were conducted using the steam ejection device for 20 days, and the total cerebral hemoglobin contents were quantified by a near-infrared spectroscopic method. As a result, the steam ejection device group showed a significant increase in total cerebral hemoglobin content, compared to the control. This result likely indicates that the cerebral blood volume is increased as a result of the steam treatment using the steam ejection device, which promotes oxidization.

Figure 13:
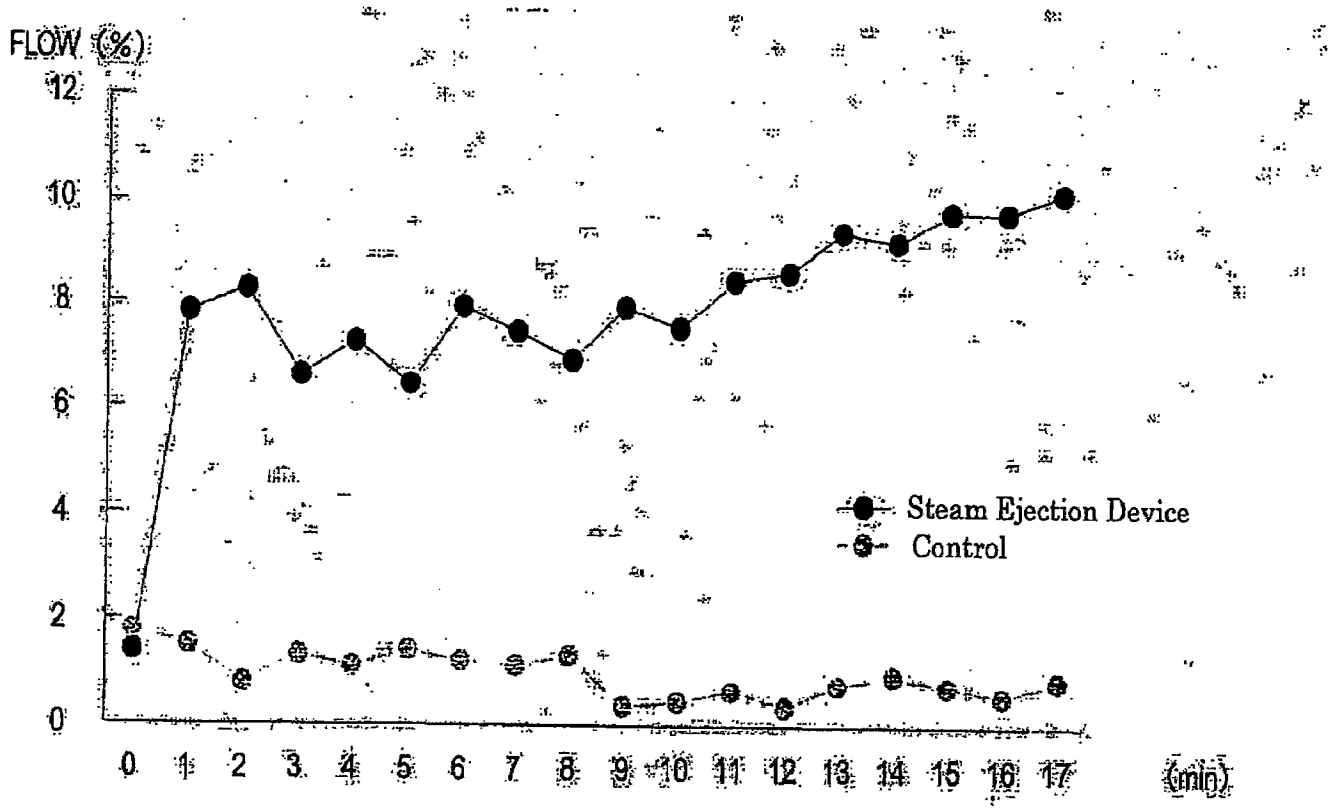
FIG. 13 is a graph showing a blood flow change rate of the peripheral vessel in Example 3.

FIG. 13 shows a change rate of the peripheral vessel blood flow obtained by use of the steam ejection device. The results revealed that facial and body steam treatments using the steam ejection device increased the cerebral blood volume, promoting blood circulation. Similarly, the use of the steam ejection device resulted in a significant high level of peripheral vessel blood flow, compared to the control.

Example 4

The present invention is hereinafter explained in further detail, with reference to examples and comparative examples; however, the present invention is not limited to these embodiments.

Figure 3:
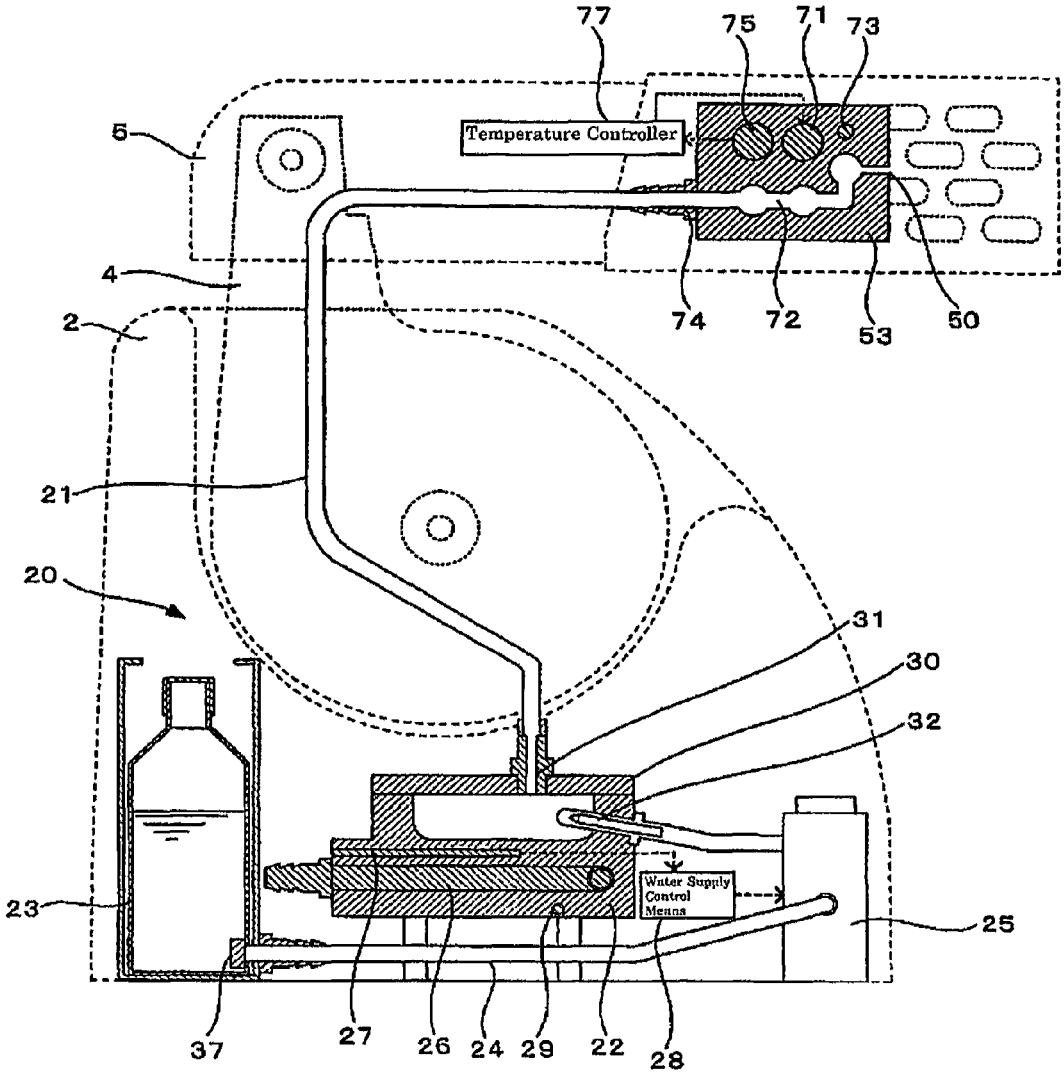
FIG. 3 is a schematic view showing an internal construction of the steam ejection device shown in FIG. 1.

The steam ejection test was conducted using the steam ejection device 1 including the steam generator 20 shown in FIG. 3.

The steam-generating heating element 26 in the steam generator 20 was an electrical heater having a heating capacity of 1.3 kw/h. Further, the steam-generating heating element 26 was configured to stop energization when the detected temperature of the steam-generating temperature detector was 150° C. or more.

The water supply pump 25 was a small electromagnetic pump, which is capable of controlling ON/OFF operations. Further, the water supply pump 25 was configured such that when the detected temperature of the steam-generating temperature detector 27 was 140° C. or more, the water supply pump 25 was in the ON state for three seconds per unit time (100 seconds), producing a flow rate of 30 ml/100 sec, whereas when the detected temperature was 140° C. or less, the pump was in the ON state for two seconds per unit time (100 seconds), producing a flow rate of 20 ml/100 sec. Further, the pump 25 was arranged to be in the OFF state when the detected temperature of the steam-generating temperature detector 27 was 130° C. or less.

The steam ejection device 1 was actuated and energized such that the steam-generating heating element 26 had a heating value of 1.3 kw/h.

As a result, steam was constantly generated from the steam-generating vessel 22, allowing the steam ejection device 1 to emit steam continuously. In this case, the internal pressure of the steam-generating vessel 22 was 0.06 to 0.08 MPa. Further, the temperature of the steam-generating vessel 22 was maintained at approximately 140° C. In this way, it is verified that the steam ejection device of the present invention can constantly discharge steam, and efficiently use the heat of the steam-generating heating element.

The invention claimed is:

1. A steam ejection device comprising:

a steam-generating portion for generating steam by heating water;

a steam eject port for ejecting the steam generated in the steam-generating portion; and a steam-guiding portion for delivering the steam from the steam-generating portion to the steam eject port; and a steam-heating block for heating, right before the steam eject port, the steam guided via the steam-guiding portion;

the steam-generating portion comprising:

a steam-generating vessel;

a steam-generating portion heating element for heating the steam-generating vessel by its heat;

a steam-generating temperature-detecting means for detecting a temperature of the steam-generating vessel;

a water-supplying means for supplying water to the steam generating vessel; and a water supply control means controlling operation of the water-supplying means; and the water supply control means controlling a water supply amount of the water-supplying means based on the temperature detected by the steam-generating temperature-detecting means under a constant heat value of the steam-generating heating element.

2. The steam ejection device according to claim 1, which further comprises a base that horizontally rotatably supports the steam-generating portion, wherein the steam eject port is arranged to be able to rotate up and down relative to the steam-generating portion.

3. The steam ejection device according to claim 2, which further comprises a tube-like cover member extending from the steam eject port in the direction where the steam is discharged.

4. The steam ejection device according to claim 2, wherein the steam eject port is rotatably constructed at the time of steam ejection.

5. The steam ejection device according to claim 1, which further comprises a tube-like cover member extending from the steam eject port in the direction where the steam is discharged.

6. The steam ejection device according to claim 5, wherein the steam eject port is rotatably constructed at the time of steam ejection.

7. The steam ejection device according to claim 1, wherein the steam eject port is rotatably constructed at the time of steam ejection.

8. The steam ejection device according to claim 1, wherein the steam eject port is rotatably constructed at the time of steam ejection.

* * * * *